United States Patent [19]

Axelrod

[11] 4,091,487

[45] May 30, 1978

[54] METHOD FOR BINDING BOOKS

[76] Inventor: Herbert R. Axelrod, 211 West Sylvania Ave., Neptune, N.J. 07753

[21] Appl. No.: 634,546

[22] Filed: Nov. 24, 1975

[51] Int. Cl.[2] ..... B42C 19/00; B42D 1/00

[52] U.S. Cl. ..... 11/1 AD; 281/21 R

[58] Field of Search ..... 281/21–29; 11/1 AD, 1 R

[56] References Cited

U.S. PATENT DOCUMENTS 3,210,093 10/1965 Steidinger ..... 281/21 R 3,749,422 7/1973 Abildgaard et al. ..... 281/21 R

*Primary Examiner*—Stephen C. Pellegrino

*Attorney, Agent, or Firm*—Fulwider, Patton, Rieber, Lee & Utecht

[57] ABSTRACT

There is disclosed a method for binding books utilizing a plurality of signatures which are glued together along a spine. First and second additional signatures or covers are thereafter glued to such spine. The outermost of said special signatures is glued to the interior surface of a hard cover.

3 Claims, 12 Drawing Figures

METHOD FOR BINDING BOOKS

BACKGROUND OF THE INVENTION

The invention relates to a method for binding books which is more economical than conventional case binding, but provides a book which is as strong or stronger than the books provided by the usual case binding methods.

In case binding, considerable hand labor is required to sew collated signatures together. Conventional perfect binding utilized to bind so-called "paperback" books is less expensive than case binding, since the amount of hand labor is reduced. It will be apparent, however, that paperback books do not have the same high quality appearance as hard cover books.

It is a major object of the present invention to provide a method for binding books which utilizes the economics achieved by perfect binding to provide a book having the appearance of a book made by case binding.

It is another object of the present invention to provide a method of the aforedescribed nature which is capable of being carried out by present book binding equipment.

Yet a further object of the present invention is to provide a method for binding books of the aforedescribed nature which results in a book having as great or greater strength than books produced by conventional case binding.

SUMMARY OF THE INVENTION

The method of the present invention includes printing a plurality of signatures and thereafter collating the printed signatures so that pagination is in seriatim; the first signature and the last signature are special signatures of a single or multiple sheet, usually of unprinted paper. This special signature or signatures may be of heavier paper stock than the printed signatures.

Next, the spine or backbone of the collated signatures is cut off and the edges thereof glued together. Then a paper cover is wrapped around the collated signatures and glued onto the spine. This paper cover is usually the same paper as that used in the first and last signature. The collated, covered signatures are then trimmed on the three exterior edges. Finally, the exterior surfaces of the paper cover are glued to the interior surfaces of the conventional hard cover.

Alternatively, instead of adding a special first and last signature to the collated book, two paper covers can be affixed, with one cover atop the other cover, glued along the spine. The inside cover is attached to the spine as described above; the outside cover is attached to the inside cover at the same edge.

DESCRIPTION OF THE PREFERRED EMBODIMENTS

Figure 1:
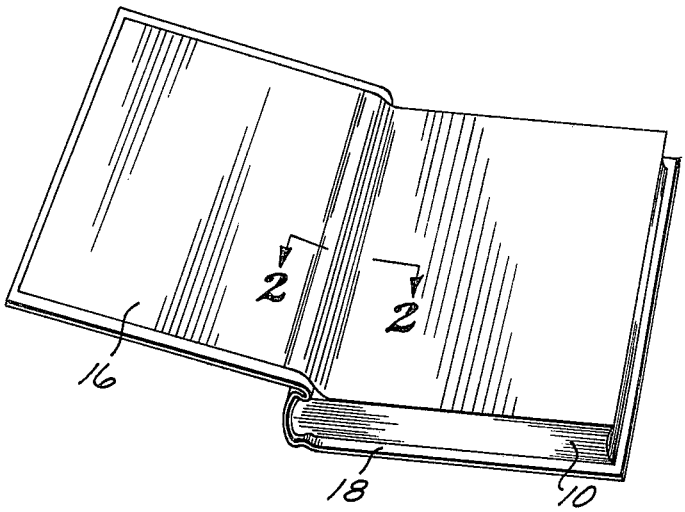
FIG. 1 is a perspective view showing a book produced by a conventional case binding method.
Figure 2:
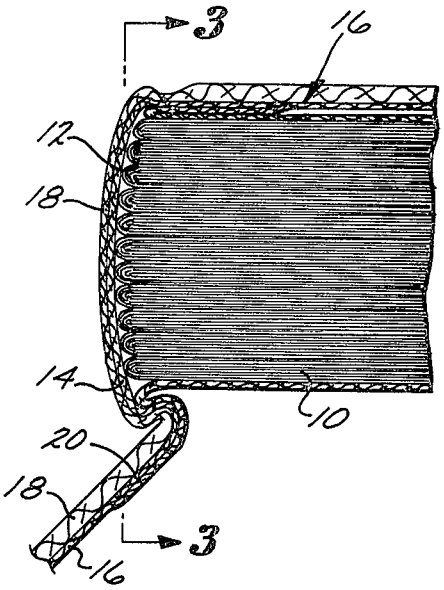
FIG. 2 is a broken vertical sectional view taken in enlarged scale along line 2—2 of FIG. 1.
Figure 3:
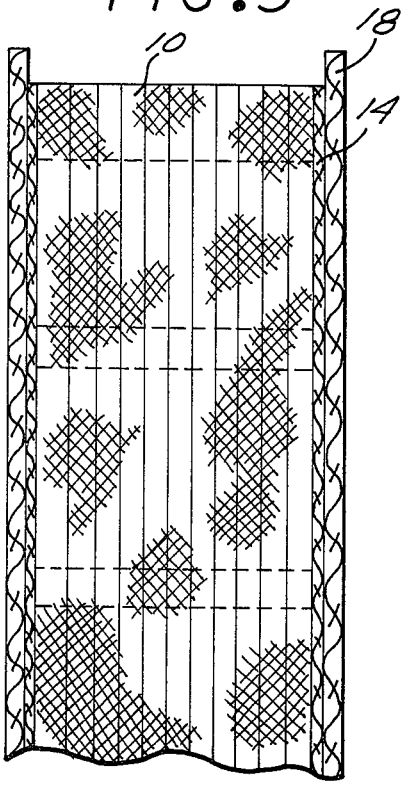
FIG. 3 is a broken vertical sectional view taken along line 3—3 of FIG. 2.

Referring to the drawings, and particularly to FIGS. 1, 2 and 3 thereof, there is shown a book produced by a conventional case binding method. Such book includes a plurality of signatures 10 which have been printed, collated, gathered and thereafter sewn together and glued along a spine 12. A rectangular piece of gauze or adhesive tape 14 is applied over the spine 12 of the signatures 10 by gluing. Such gauze 14 is generally termed "crash". Separate outer signatures 16, termed "end papers", are glued to the interiors of a hard cover 18. As indicated particularly in FIG. 3 at 20, the crash 14 extends beyond the top and bottom of the signatures 10. The outer signature 16 is generally of heavier stock than the individual pages of the printed signatures 10.

It should be understood that the hard cover 18 is of conventional construction and the mid-portion thereof is glued over the gauze crash 14. It will also be understood that the conventional case binding method requires considerable hand labor, particularly to accomplish the sewing together of the signatures 10.

Figure 4:
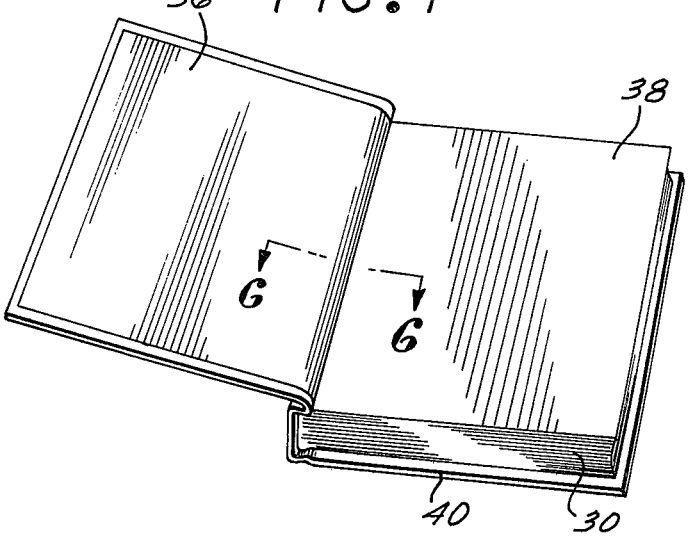
FIG. 4 is a perspective view similar to FIG. 1, but showing a book produced by a preferred method embodying the present invention.
Figure 5:
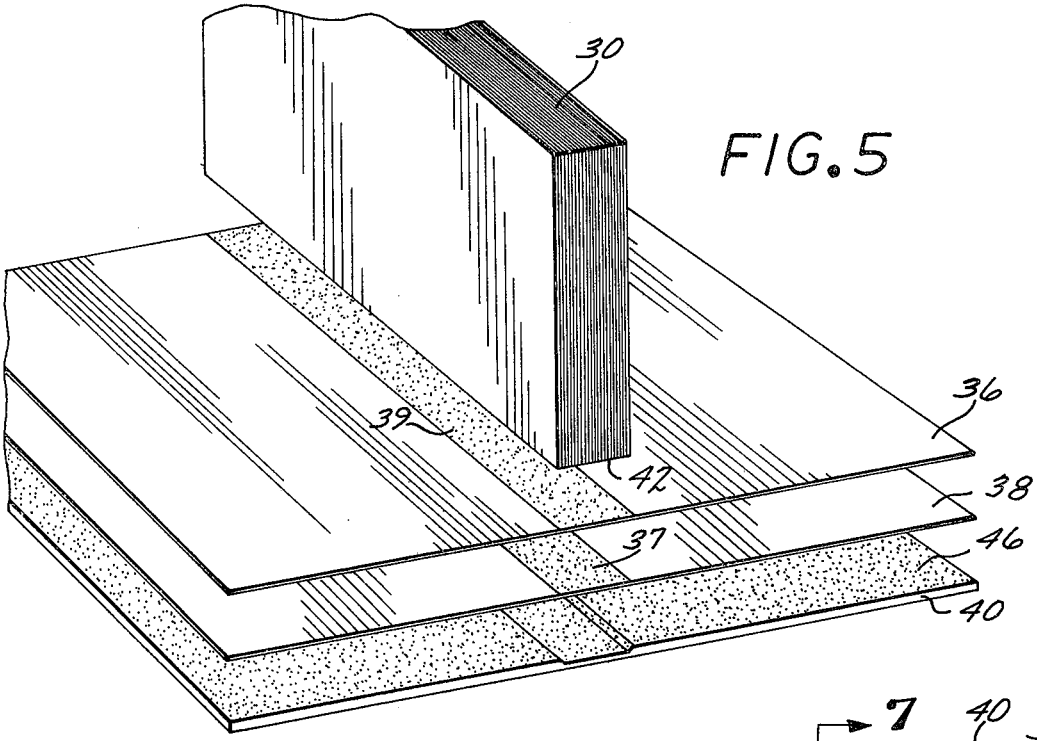
FIG. 5 is a broken, vertically exploded perspective view showing a step in the method of the present invention.
Figure 6:
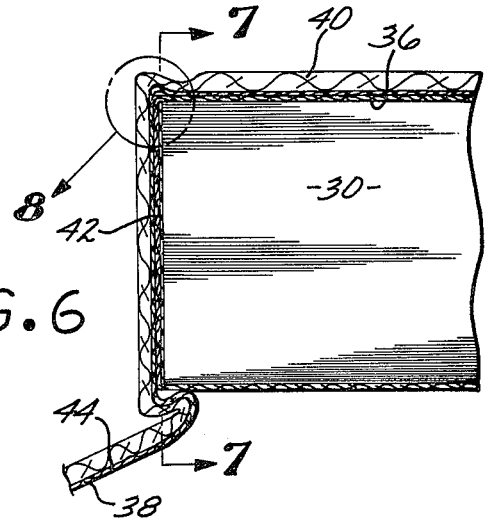
FIG. 6 is a broken vertical sectional view taken in enlarged scale along line 6—6 of FIG. 4.
Figure 7:
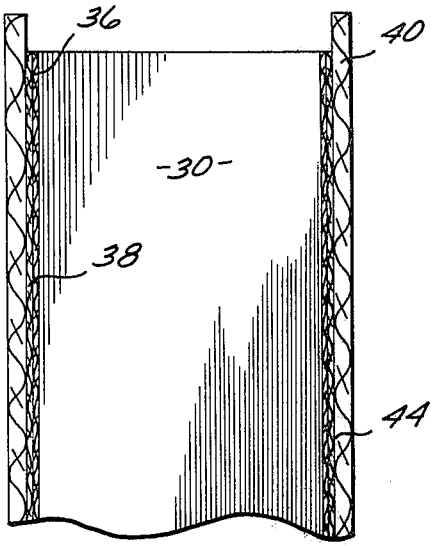
FIG. 7 is a broken vertical sectional view taken on line 7—7 of FIG. 6.

Referring now to FIGS. 4–8 of the drawings, there is shown therein a first preferred method for binding books embodying the present invention. With particular reference first to FIG. 5, the method includes printing a plurality of signatures 30 and thereafter collating such printed signatures so that pagination is in seriatim. Thereafter, the spine (not shown) of the gathered signatures is cut off and the edges thereof are glued together.

Figure 8:
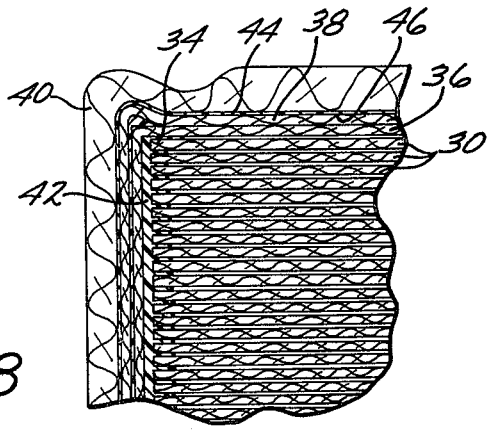
FIG. 8 is an enlarged view of the area designated 8 in FIG. 6.
Figure 9:
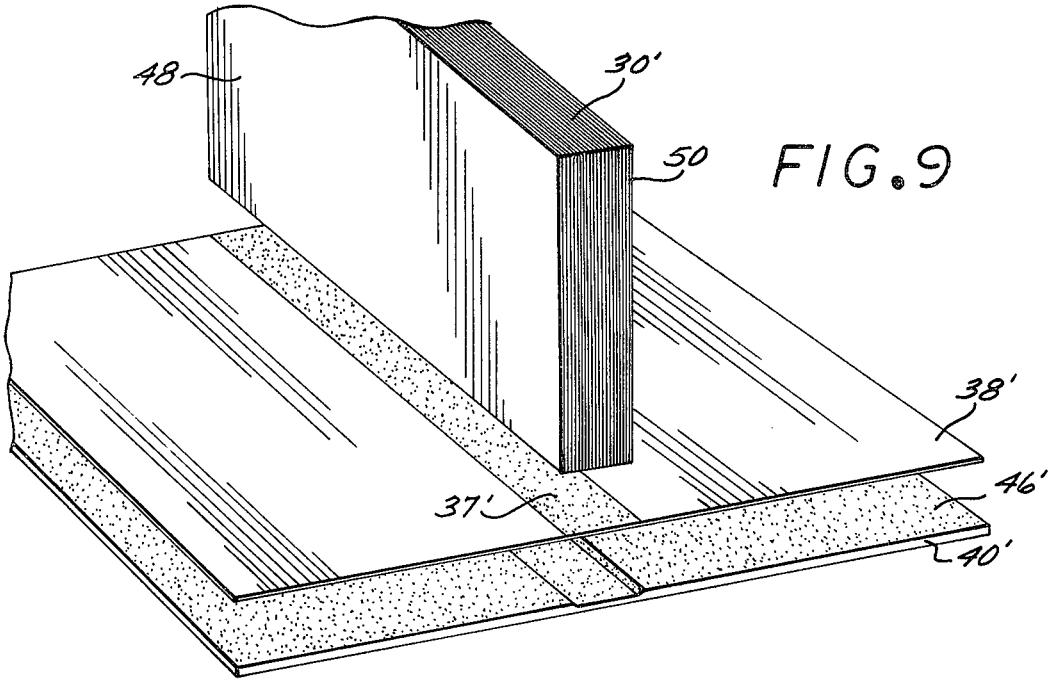
FIG. 9 is a broken vertically exploded perspective view showing a step in a second method embodying the present invention.
Figure 10:
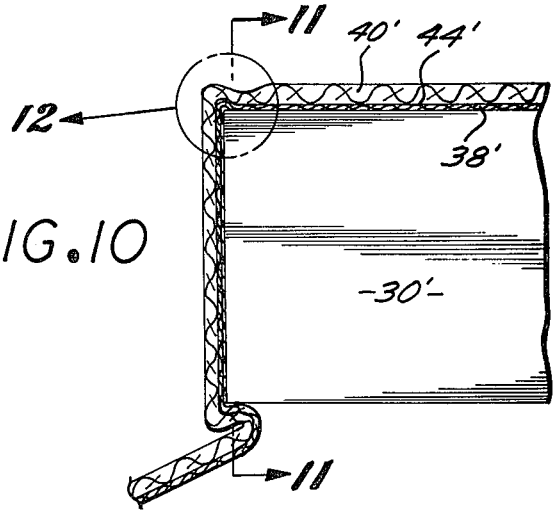
FIG. 10 is a broken vertical sectional view similar to FIG. 6.
Figure 11:
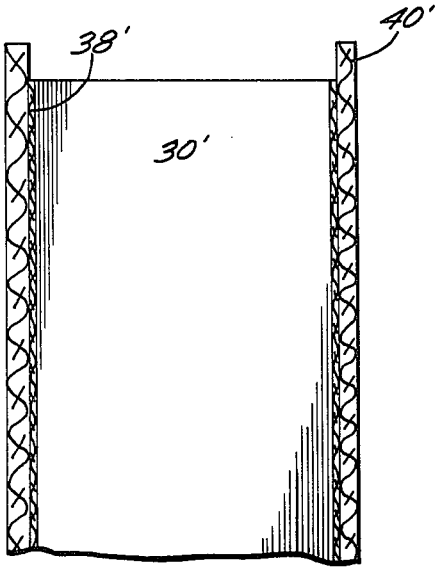
FIG. 11 is a broken vertical sectional view taken along line 11—11 of FIG. 10.
Figure 12:
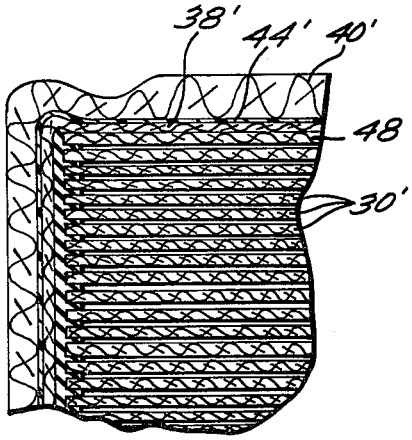
FIG. 12 is an enlarged view of the area designated 12 in FIG. 10.

Referring to FIG. 8, glue is indicated at 34 between the pages of the signatures 30. With continued reference to FIG. 5, there is shown a special inside paper cover 36 and a special outside paper cover 38. Paper covers 36 and 38 are preferably of considerably heavier stock than the stock of printed signatures 30. Also shown is a conventional hard cover 40. The cut-off back surface 42 of the glued-together printed signatures 30 is glued to the mid-portion of the inside paper cover 36. Similarly, the mid-portion 37 of the outside paper cover 38 is glued to the exterior of the inside paper cover 36 over the mid-portion 39 thereof. Then the three other edges are trimmed or cut, if necessary. Finally, the exterior surface 44 of the outside paper cover 38 is glued to the interior surface 46 of the hard cover 40. Preferably, the entire abutting surfaces 44 and 46 of outside paper cover 38 and the hard cover 40 are adhered together. The book binding method is completed when the glue has dried.

The finished book is shown in FIG. 4. Referring thereto, it should be noted that the appearance of the special covers 36 and 38 is substantially the same as when a book is bound by the conventional case binding method. Yet the cost of binding a book utilizing the method of the present invention is much less than if the case binding method was employed. This is particularly true since the method of the present invention can be carried out with conventional manufacturing equipment, and, of course, the hand labor of stitching and covering is eliminated. It is also important to observe that a book made by the present method will be as strong or even stronger than a book made by case binding. This is true because the printed signatures 30 are secured to the hard cover 40 by the inside and outside paper covers 36 and 38 which are glued to the entire back surface 42 of the adhered-together printed signatures, with such back surface serving as a spine having the opposite flexible edges thereof forming conventional hard cover hinges.

Referring now to FIGS. 9–12 of the drawings, there is shown a second preferred method for binding books embodying the present invention. In FIGS. 9–12, like parts bear primed referenced numerals.

The method illustrated in FIGS. 9–12 is substantially the same method illustrated in FIGS. 4–8. An exception, however, is the elimination of the inside paper cover 36. Additionally, the gathered glued-together and trimmed signatures 30 include self-ends 48 and 50 of the same paper stock as signatures 30. Alternately, the outer sheets 48 and 50 may be individual sheets usually of the same paper stock as cover 36'. This arrangement permits the use of most conventional automatic "perfect" binding machines, such machines being capable of applying a single covering without any modification.

A book made in accordance with either embodiment of the present invention will be more resistant to breakdown of the glued signatures than conventional paperback books. This results from the fact that the hard covers restrain the signatures against being opened so far as to break down the glue holding the signatures together.

Various modifications and changes may be made with respect to the foregoing detailed description without departing from the spirit of the present invention.

I claim:

1. A method of binding hard cover books, including:

printing a plurality of signatures;

folding said signatures;

collating said printed signatures to position the folded-over edges of adjacent signatures in juxtaposition with one another to form a back bone and to place the pagination in seriatum;

cutting of said back bone to separate the edges of each page of said signatures from one another to form a flat cut off back surface;

applying flowable glue to said back surface and in between the edges of adjacent edges of said pages along said back surface;

providing a paper cover of heavier stock than said signatures and of sufficient size to form opposite sides to cover the opposite sides and a back side to cover the back surface of said collated signatures;

pressing said back side of said paper cover to said glue along said back surface;

providing a hard cover of sufficient size to cover the opposite exteriors of said paper cover and to pass around the back side of said cover and of sufficient flexibility along the opposite sides of said back to form respective hinges therealong; and gluing the interior surfaces of the opposite sides of said hard cover to the exterior surfaces of the opposite sides of said paper cover and the back of said cover to cooperate therewith in forming a spine.

2. A method of binding hard cover books, including:

printing a plurality of signatures;

folding said signatures to form a folded-over back edge;

collating said printed signatures to position said folded-over edges in juxtaposition with one another to form a back bone and to place the pagination in seriatum;

cutting off said back bone to separate the edges of each page of said signatures from one another to form a flat cut off back surface;

applying flowable glue to said back surface;

providing an inside paper cover having opposite sides of sufficient size to cover the opposite sides of said collated signatures and a back side to extend around said back surface;

gluing the back side of said inside paper cover to said back surface;

providing an outside paper cover of heavier stock than said signatures and having opposite sides of sufficient size to cover the opposite sides of said inside cover and a back side to cover the back surface of said collated signatures;

applying glue to the exterior surface of the back side of said inside cover and to the exterior surface of the opposite sides thereof;

providing a hard cover of sufficient size to cover the opposite exteriors of said paper cover and to pass around the back side of said cover and of sufficient flexibility along the opposite sides of said back to form respective hinges therealong; and gluing the interior surfaces of the opposite sides of said hard cover to the exterior surfaces of the opposite exterior sides of said outside cover and to the back side of said cover to cooperate therewith in forming a spine along such back side.

3. A method as set forth in claim 1, wherein said hard cover is formed to project beyond the top and bottom ends and front edges of said collated signatures.

* * * * *